US007077644B1

(12) United States Patent
Bowman et al.

(10) Patent No.: US 7,077,644 B1
(45) Date of Patent: Jul. 18, 2006

(54) ADVANCED COMMERCIAL RANGE BURNER

(75) Inventors: John A. Bowman, Lancaster, MA (US); Steven Casey, Arlington, MA (US)

(73) Assignee: Gas Technology Institute, Des Plaines, IL (US)

( * ) Notice: Subject to any disclaimer, the term of this patent is extended or adjusted under 35 U.S.C. 154(b) by 0 days.

(21) Appl. No.: 11/031,239

(22) Filed: Jan. 7, 2005

(51) Int. Cl.
*F23D 14/06* (2006.01)

(52) U.S. Cl. ..... 431/354; 431/349; 126/39 E

(58) Field of Classification Search ..... 431/354, 431/349, 286; 126/39 E
See application file for complete search history.

(56) References Cited

U.S. PATENT DOCUMENTS

| | | | | |
|---|---|---|---|---|
| 2,320,754 | A * | 6/1943 | Sherman | 126/39 K |
| 2,485,145 | A * | 10/1949 | Evans | 126/214 R |
| 2,817,397 | A * | 12/1957 | Brumbaugh | 239/544 |
| 3,627,462 | A * | 12/1971 | Lotter | 431/284 |
| 3,635,209 | A * | 1/1972 | Vignes | 126/39 H |

FOREIGN PATENT DOCUMENTS

| | | | |
|---|---|---|---|
| JP | 56-87712 | * | 7/1981 |
| JP | 56-165812 | * | 12/1981 |
| JP | 57-37618 | * | 3/1982 |
| JP | 57-58008 | * | 4/1982 |
| JP | 08-247407 | * | 9/1996 |
| JP | 09-4853 | * | 1/1997 |
| JP | 09-79523 | * | 3/1997 |
| JP | 2002-206711 | * | 7/2002 |
| JP | 2004-205102 | * | 7/2004 |

* cited by examiner

*Primary Examiner*—Carl D. Price

(57) ABSTRACT

A gas-fired burner including a cylindrical burner housing having a premixed fuel/air opening. Disposed within the cylindrical burner housing is a cylindrical burner ring which forms at least one row of a plurality of burner ports. The cylindrical burner ring is sized relative to the burner housing such that an annular space is formed between the burner housing and the burner ring. Upper and lower annular rings extend between the burner ring and the burner housing, thereby enclosing the annular space. Disposed within the burner ring is a secondary air flow restrictor for controlling the flow of secondary air to the flame. A multi-finger grate having alternating long and short fingers is disposed above the burner housing.

16 Claims, 6 Drawing Sheets

ADVANCED COMMERCIAL RANGE BURNER

BACKGROUND OF THE INVENTION

1. Field of the Invention

This invention relates to a burner system for range top applications. More particularly, this invention relates to partially premixed, gas-fired burners for use in atmospheric range tops. Range tops to which this invention is particularly applicable are commercial range tops.

2. Description of Related Art

Conventional gas-fired burners for commercial range tops are atmospheric, partially premixed burner systems having overall thermal efficiencies in the low to mid 40's percent range. In conventional gas-fired burner systems, the flame is produced by a circular burner ring which produces flames which are generally in contact only with the perimeter bottom of a pot or pan (cooking surface).

Most efforts to improve the thermal efficiency have focused on powered burner systems for fully premixed operation of burners with shorter flame length characteristics that allow the burner to be located closer to the cooking surface, thereby increasing thermal efficiency. One effort to improve thermal efficiency is an internal multiple flame port burner developed jointly by a number of Japanese gas companies. This burner is said to improve heating efficiency by 10–25%. The main feature of this burner is a relatively long flame which extends from the center of the burner ring. As a result, during cooking, the flame contacts the center of the cooking surface and spreads outwardly therefrom.

Notwithstanding improvements made to date, room for improvements still remains.

SUMMARY OF THE INVENTION

Accordingly, it is one object of this invention to provide a gas-fired burner system for range top applications which provides higher thermal efficiencies than conventional burner systems, typically in the range of about 46–50%.

It is another object of this invention to provide a gas-fired burner system for range top applications having significantly faster times-to-boil than conventional burner systems.

It is yet a further object of this invention to provide a gas-fired burner system for range top applications that is capable of operating at higher firing rates than conventional burner systems without increasing the space occupied by conventional burner systems (i.e. footprint).

These and other objects of this invention are addressed by a gas-fired burner comprising a cylindrical burner housing having a premixed fuel/air opening. Disposed within the cylindrical burner housing is a cylindrical burner ring having a top end and a bottom end, which cylindrical burner ring forms at least one row of a plurality of burner ring ports. The cylindrical burner ring is sized relative to the burner housing such that an annular space is formed between the burner housing and the burner ring. Upper and lower annular rings extend between the burner ring and the burner housing, thereby enclosing the annular space. Disposed within the interior space enclosed by the burner ring at a distance from the top end of the burner ring is a secondary air flow restriction means for controlling the flow of secondary air to the flame. A multi-finger grate having alternating long and short fingers extending above the interior space enclosed by the burner ring is disposed above the burner housing. In addition to providing support for the cooking surface, the multi-finger grate is also a significant factor in the operation of the burner. The burner in accordance with this invention provides as much as a 33% faster time-to-boil than conventional burner systems, thermal efficiencies in the range of about 46–50% and higher firing rates within the same burner footprint—30,000 Btu/hour versus 26,000 Btu/hour.

BRIEF DESCRIPTION OF THE DRAWINGS

These and other objects and features of this invention will be better understood from the following detailed description taken in conjunction with the drawings wherein.

DETAILED DESCRIPTION OF THE PRESENTLY PREFERRED EMBODIMENTS

The burner system of this invention for range top applications, typically commercial range top applications, comprises four basic components—a cylindrical burner ring with inwardly firing burner ports, secondary air flow control surfaces, a burner housing to hold and enclose the outer surface of the burner ring and to distribute a mixture of fuel and air around the burner ring, and a range top grate. These four components function together to provide the improvements previously described compared to conventional range top burners while complying with ANSI emission and efficiency standards. These improvements result from two primary aspects of the burner system—1) the burner ring and secondary air flow control surfaces, which produce a larger and more uniform heat flux area on the bottom surface of a cooking vessel, particularly large pots, that yields significantly faster time-to-boil and higher thermal efficiency than conventional systems; and 2) the shape and arrangement of the burner ports in the burner ring, the shape and spacing of the secondary air flow control surface(s), and the spacing of the grate assembly, which permit higher firing rates through flame paths that are sufficiently long enough yet limited in the extent to which the flame impinges upon comparatively cold surfaces to fully react the fuel and air and to minimize carbon monoxide emissions.

Figure 1:
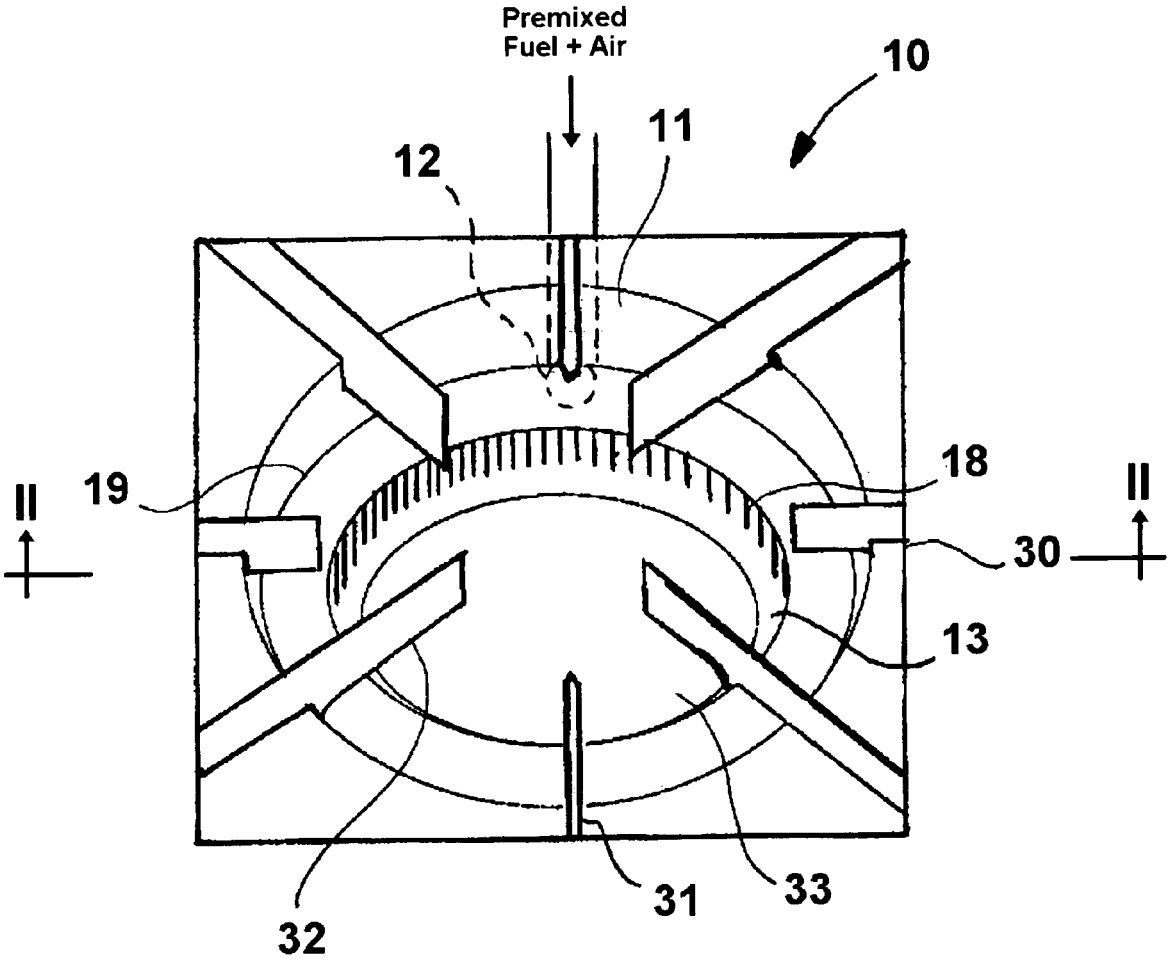
FIG. 1 is a perspective view of a burner in accordance with one embodiment of this invention.
Figure 2:
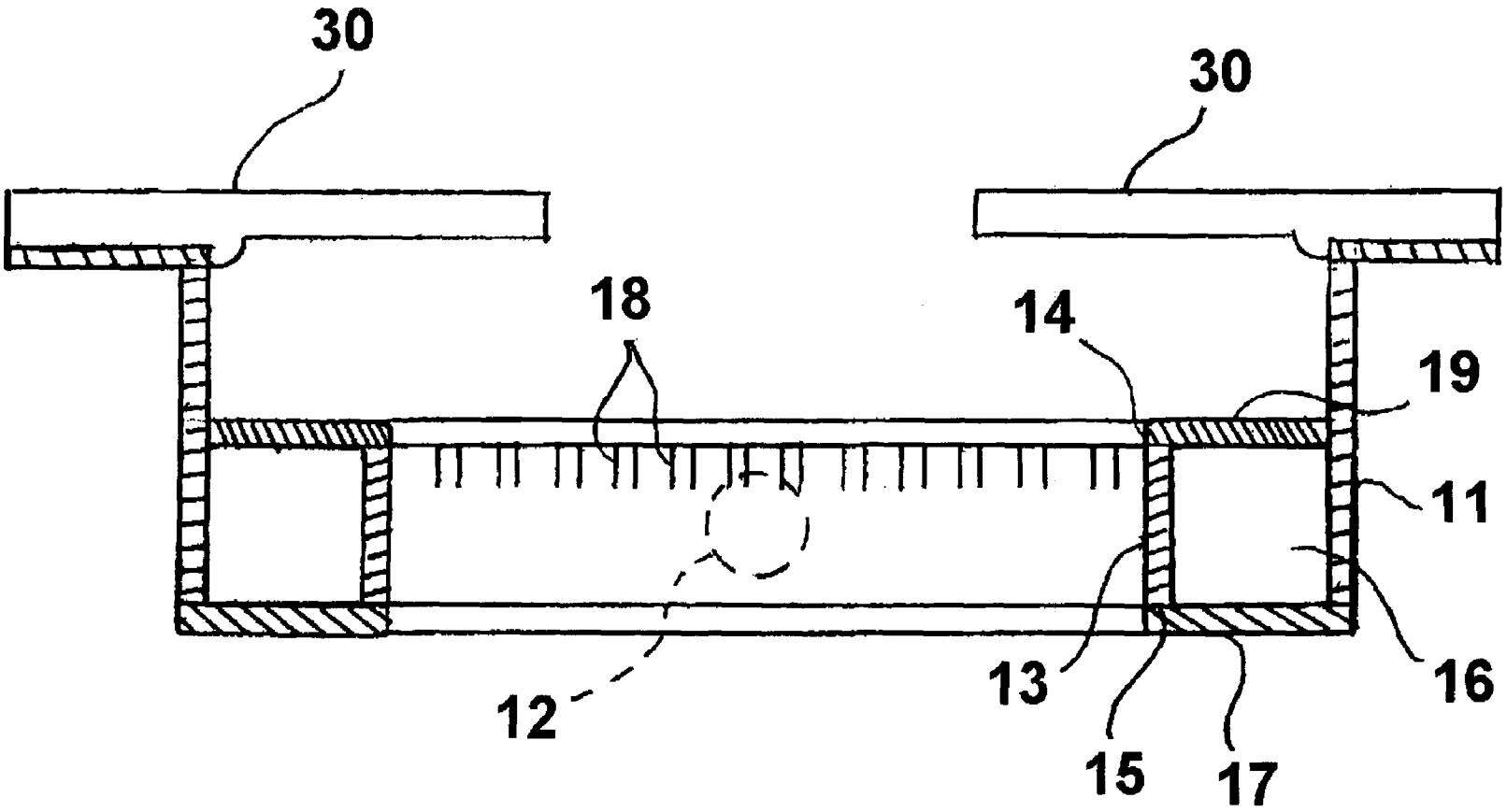
FIG. 2 is a cross-sectional view of the burner of FIG. 1 taken along the line 11—11.
Figure 4:
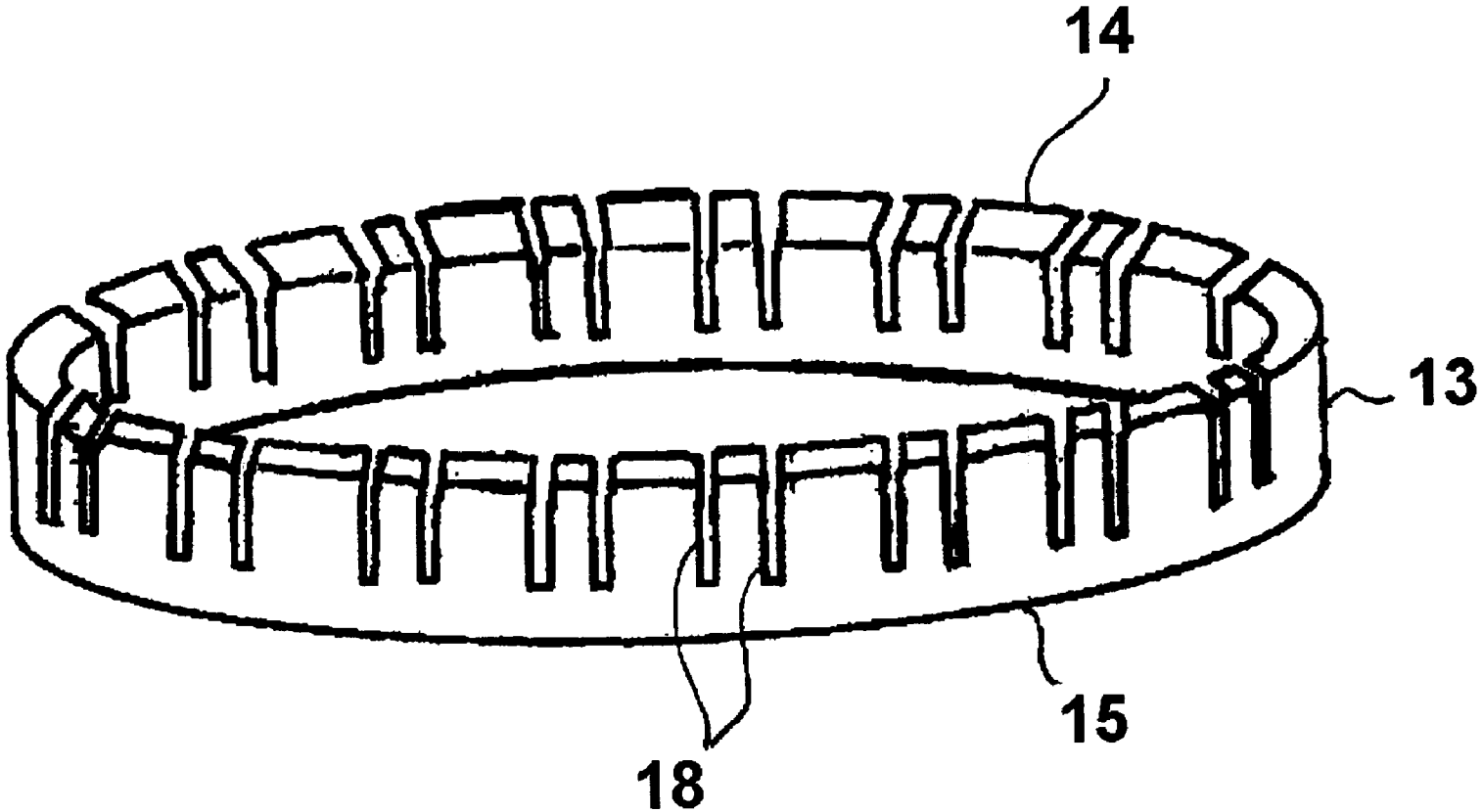
FIG. 4 is a perspective view of a cylindrical burner ring for a burner in accordance with one embodiment of this invention.
Figure 5:
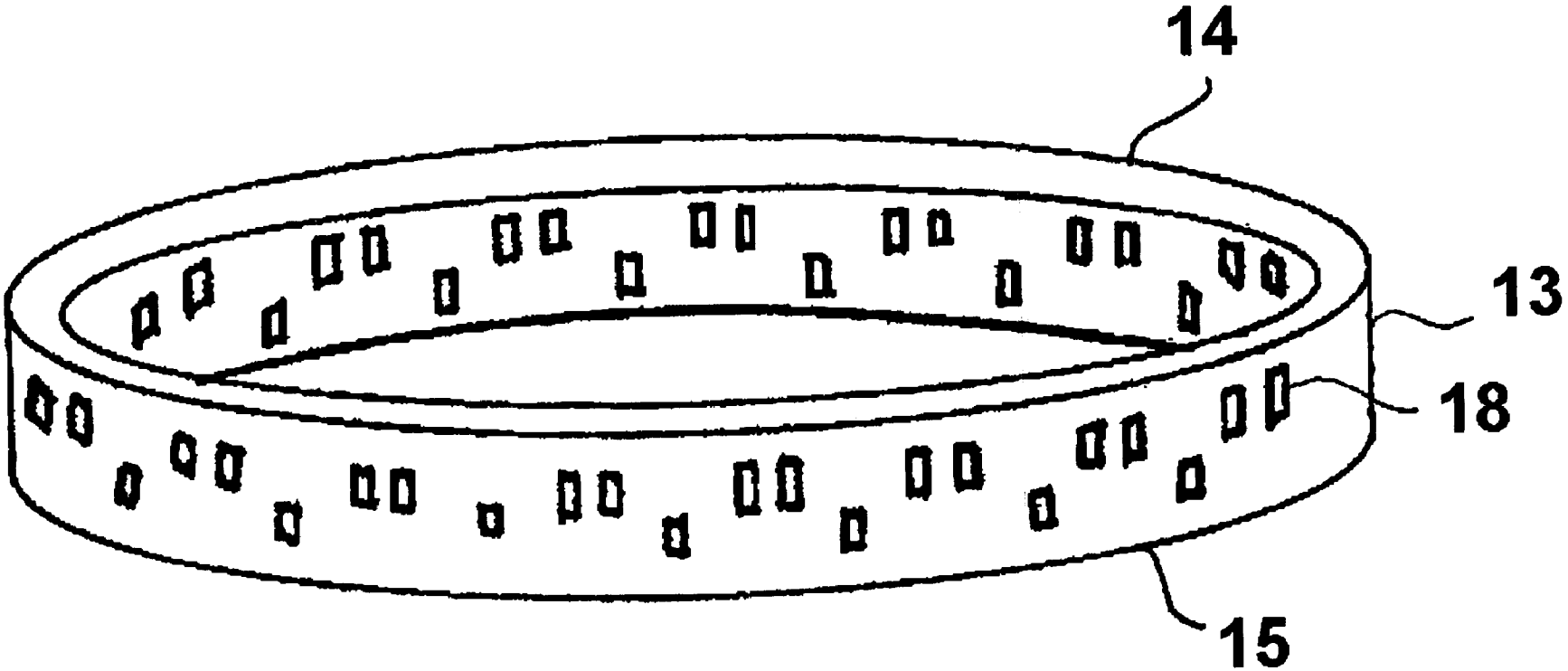
FIG. 5 is a perspective view of a cylindrical burner ring for a burner in accordance with another embodiment of this invention.

A gas-fired burner system for range top applications in accordance with one embodiment of this invention is shown in FIGS. 1 and 2. Burner system 10 comprises a cylindrical wall 11 defining a burner housing, which burner housing forms a premixed fuel/air opening 12 for introducing a mixture of fuel and air into the housing. Cylindrical burner ring 13 having a top end 14 and a bottom end 15, as shown in FIGS. 4 and 5, is disposed within the burner housing, forming annular space 16 between cylindrical burner ring 13 and cylindrical wall 11, as shown most clearly in FIG. 2. Extending between top end 14 of cylindrical burner ring 13 and cylindrical wall 11 is a substantially planar upper annular ring 19 and extending between bottom end 15 of cylindrical burner ring 13 and cylindrical wall 11 is a substantially planar lower annular ring 17, whereby annular space 16 is fully enclosed.

Cylindrical burner ring 13 forms at least one row of burner ports 18. In accordance with one particularly preferred embodiment of this invention, burner ports 18 are in the form of vertically elongated slots. In the burner ring configuration shown in FIG. 4, in accordance with one embodiment of this invention, vertically elongated burner ports or slots 18 extend all the way through the top end of burner ring 13. By way of example, burner ring 13 measures approximately 6" in outer diameter and ⅛" in thickness. The burner ports are approximately 0.063" wide by about 1" long.

Figure 6:
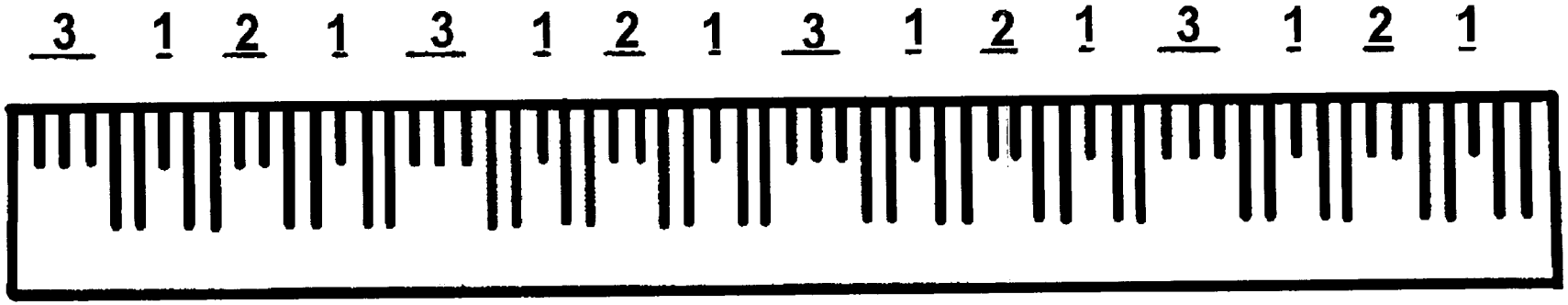
FIG. 6 is a diagram showing the 3-2-1 pattern of ports formed by the cylindrical burner ring in accordance with one embodiment of this invention.

In accordance with one preferred embodiment of this invention, burner ports 18 are arranged around the circumference of burner ring 13 in a pattern referred to herein as a "3-2-1" pattern, a pattern in which no more than two burner ports are immediately adjacent to each other. The "3-2-1" pattern is a design created from a burner ring 13 having 60 equally spaced burner ports 18. FIG. 6 is a diagram showing a linear form of a burner ring in accordance with one embodiment of this invention with 60 equally spaced burner ports. Implementation of the "3-2-1" pattern involves the removal from use of certain of the burner ports, removal being accomplished, for example, by filling in or otherwise blocking off the unused ports. Those ports which are "removed" from the burner ring are represented as shortened vertical lines, whereas those ports which are not removed are represented as longer vertical lines. To produce the "3-2-1" arrangement of burner ports in accordance with one embodiment of this invention (based upon the presence initially of 60 burner ports), three adjacent burner ports are removed in each of four equally spaced locations. Thus, three adjacent burner ports, identified by the numeral 3 in FIG. 6, are removed from four locations on the cylindrical burner ring disposed 90° apart. Thereafter, two adjacent burner ports, identified by the numeral 2, are removed in each of four equally spaced locations that are located 45° from the previously blocked ports. Finally, one burner port, identified by the numeral 1, is removed in each of eight locations of the burner ring such that no more than two burner ports are immediately adjacent to each other. It is to be understood that the "3-2-1" pattern described herein may be applied to burner rings having other than 60 burner ports.

In the burner ring configuration shown in FIG. 5, in accordance with one embodiment of this invention, burner ring 13 forms a plurality of rows of burner ports 18, at least a portion of which are fully contained within burner ring 13. Preferably, as shown in FIG. 5, the burner ports are aligned such that no burner ports in any of the rows is vertically aligned with a burner port of any other of the rows. In accordance with an exemplary embodiment, burner ring 13 measures about 6" in outer diameter and about ⅛" in thickness. In the upper row, there are preferably 40 vertically elongated burner ports measuring about 0.046" wide by about 3/16" long. In the lower row, there are 20 burner ports measuring about 0.046" wide by about 7/32" long. The burner ports 13 are arranged around burner ring 13 in 60 equally spaced locations so that only one burner port is in each of the sixty locations. It will be understood by those skilled in the art that the burner ring size and the burner port dimensions are fully scalable to accommodate different firing rates and/or to optimize the burner system's heat flux pattern to the range of cooking surface sizes expected to be used.

As previously indicated, burner system 10 is a partially premixed burner in which a gaseous fuel, typically natural gas, is mixed with a portion of the combustion air required for complete combustion, which mixture is then introduced through premixed fuel/air opening 12 into annular space 16. The mixture then passes through burner ports 18 into the interior space 33 enclosed by burner ring 13 in which interior space the mixture is ignited, resulting in the formation of a centrally disposed flame. Secondary combustion air is drawn, by means of natural draft, upwards through the interior space 33 where it mixes with the flame, thereby completing combustion of the fuel.

Disposed above burner ring 13 is a multi-finger grate 30 for supporting the cooking surface over the burner comprising equally distributed, alternating long fingers 32 and short fingers 31. In accordance with one particularly preferred embodiment of this invention, burner ring 13 is registered or aligned with the multi-finger grate so that regions of the burner ring in which three burner ports were blocked off in accordance with the "3-2-1" port pattern described herein above are vertically aligned with the long fingers 32. For embodiments of the burner system of this invention employing a burner ring having equally distributed burner ports, with none of the ports being blocked off, no registration of the circumference of the burner ring to the grate is required to operate the burner.

Figure 3:
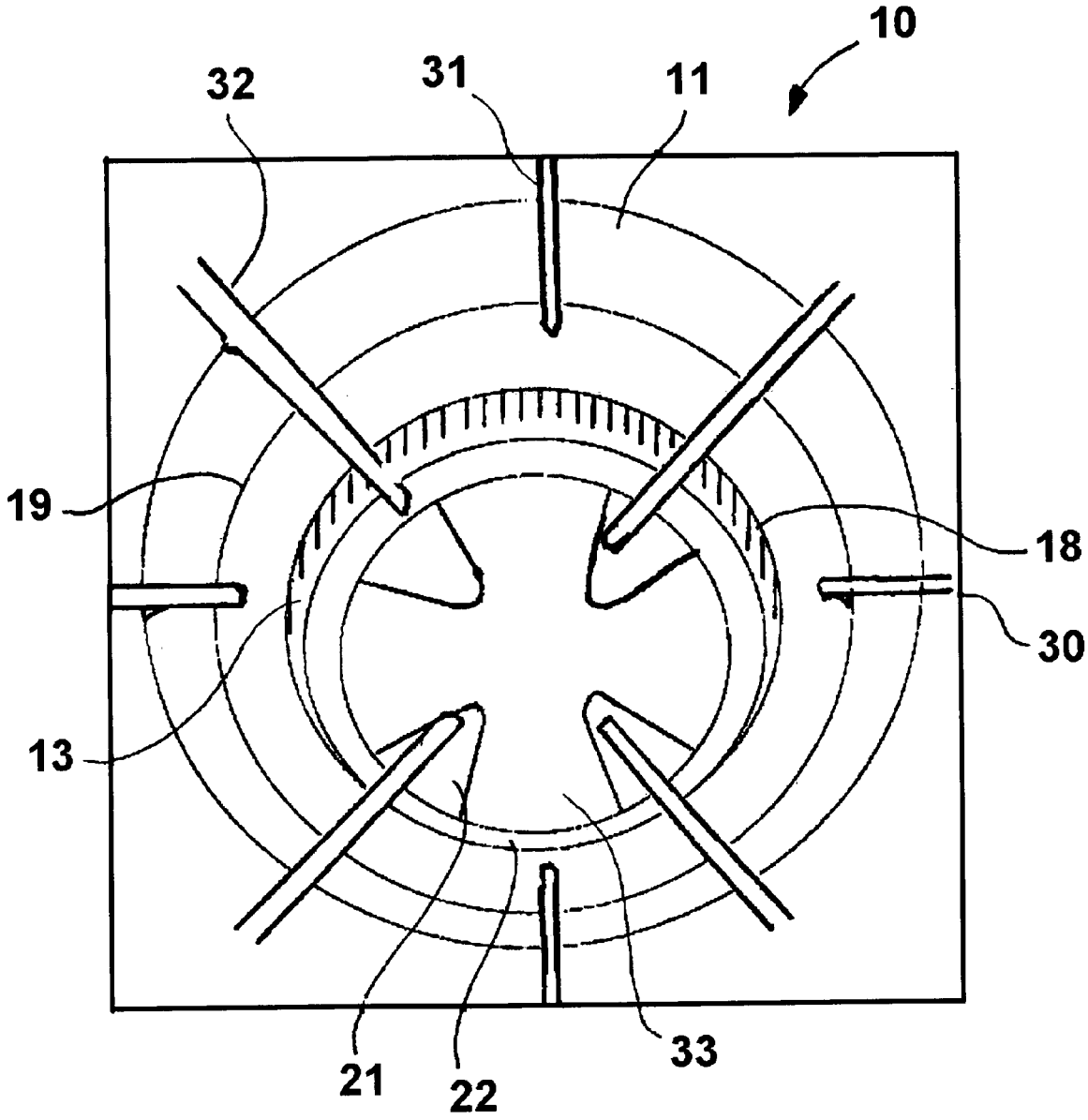
FIG. 3 is a perspective view of the burner in FIG. 1 showing secondary air flow restriction means in accordance with one embodiment of this invention.

In accordance with one embodiment of this invention, burner system 10 comprises secondary air flow restriction means whereby the flow of secondary air through the interior space 33 of the burner system is controlled to produce the desired flame characteristics and heat flux. In accordance with one embodiment of this invention, the secondary flow restriction means comprises substantially planar ring 22 disposed within the interior space 33 of the burner system at a distance vertically below the vertical disposition of burner ports or slots 18. Planar ring 22 comprises four equally distributed center oriented ring fingers 21. In accordance with one particularly preferred embodiment of this invention, ring fingers 21 are arranged within the interior space 33 of the burner system 10 so as to be vertically aligned beneath the long fingers 32 of the multi-finger grate 30 as shown in FIG. 3.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

The invention claimed is:

1. A gas-fired burner comprising:

a burner ring wall enclosing a cylindrical burner space and forming at least one row of burner ports, said cylindrical burner space having a bottom end and a top end;

a cylindrical housing wall disposed around said burner ring wall, forming an annular space between said cylindrical housing wall and said burner ring wall, said cylindrical housing wall forming a premixed fuel/air opening in fluid communication with said annular space;

an upper annular ring extending from said burner ring wall to said housing wall and a lower annular ring spaced apart from said upper annular ring extending from said burner ring wall to said housing wall, thereby enclosing said annular space;

secondary air flow restriction means for controlling flow of secondary air comprising a substantially planar ring disposed within said cylindrical burner space adjacent to said burner ring wall enclosing a centralized secondary air flow space and disposed at a distance vertically below a vertical disposition of said at least one row of burner ports, said substantially planar ring comprising a plurality of ring fingers oriented towards said centralized secondary air flow space; and a multi-finger grate having alternating long and short fingers disposed above said cylindrical housing wall.

2. A gas-fired burner in accordance with claim 1, wherein each of said ring fingers is disposed beneath and aligned with a position of said long fingers of said multi-finger grate.

3. A gas-fired burner in accordance with claim 1, wherein said burner ring wall forms a plurality of rows of burner ports.

4. A gas-fired burner in accordance with claim 1, wherein said burner ports are arranged in a 3-2-1 pattern.

5. A gas-fired burner in accordance with claim 4, wherein said long fingers of said multi-finger grate are aligned with regions of said burner ring wall in which three of said burner ports have been eliminated in accordance with said 3-2-1 pattern.

6. A gas-fired burner in accordance with claim 1, wherein said burner ports are vertically elongated slots.

7. A gas-fired burner in accordance with claim 1, wherein said plurality of burner ports are uniformly distributed around said burner ring wall.

8. A gas-fired burner in accordance with claim 7, wherein said plurality of burner ports in each of said rows are uniformly distributed around said burner ring wall whereby no said burner port in any of said rows is vertically aligned with said burner port of any other of said rows.

9. A gas-fired burner system comprising:

a cylindrical burner housing forming a premixed fuel/air opening;

a cylindrical burner ring having a top end and a bottom end disposed within said burner housing forming at least one row of a plurality of vertically elongated slots and forming an annular space between said cylindrical burner housing and said burner ring;

an upper annular ring extending between said cylindrical burner ring and said cylindrical burner housing connected with said top end of said cylindrical burner ring and a lower annular ring extending between said cylindrical burner ring and said cylindrical burner housing connected with said bottom end of said cylindrical burner ring, thereby enclosing said annular space;

secondary air flow restriction means for controlling flow of secondary air comprising a substantially planar ring disposed within an interior space enclosed by said cylindrical burner ring, adjacent to said cylindrical burner ring, and at a distance vertically below a vertical disposition of said vertically elongated slots, said substantially planar ring having a plurality of ring fingers extending into a center space enclosed by said substantially planar ring; and a multi-finger grate having alternating long and short fingers disposed above said cylindrical burner housing.

10. A burner system in accordance with claim 9, wherein each of said ring fingers is disposed beneath and aligned with a position of said long fingers of said multi-finger grate.

11. A burner system in accordance with claim 9, wherein said cylindrical burner ring forms a plurality of rows of said vertically elongated slots.

12. A burner system in accordance with claim 11, wherein said plurality of vertically elongated slots in each of said rows are uniformly distributed around said cylindrical burner ring whereby no said vertically elongated slot in any of said rows is vertically aligned with said vertically elongated slot of any other of said rows.

13. A burner system in accordance with claim 9, wherein said vertically elongated slots extend through said top end of said cylindrical burner ring.

14. A burner system in accordance with claim 9, wherein said vertically elongated slots are arranged in a 3-2-1 pattern.

15. A burner system in accordance with claim 14, wherein said long fingers of said multi-finger grate are aligned with regions of said cylindrical burner ring in which three of said vertically elongated slots have been eliminated in accordance with said 3-2-1 pattern.

16. A burner system in accordance with claim 9, wherein said plurality of vertically elongated slots are uniformly distributed around said cylindrical burner ring.

* * * * *